US009571919B2

(12) United States Patent
Hsu Huang et al.

(10) Patent No.: US 9,571,919 B2
(45) Date of Patent: Feb. 14, 2017

(54) WEARABLE SOUND BOX APPARATUS

(71) Applicant: JAZZ HIPSTER CORPORATION, New Taipei (TW)

(72) Inventors: Yueh-Hua Hsu Huang, New Taipei (TW); Chin-Ghui Huang, New Taipei (TW)

(73) Assignee: JAZZ HIPSTER CORPORATION, New Taipei (TW)

( * ) Notice: Subject to any disclaimer, the term of this patent is extended or adjusted under 35 U.S.C. 154(b) by 225 days.

(21) Appl. No.: 14/491,480

(22) Filed: Sep. 19, 2014

(65) Prior Publication Data

US 2016/0088378 A1 Mar. 24, 2016

(51) Int. Cl.

| | |
|---|---|
| ***H04R 1/10*** | (2006.01) |
| ***H04R 1/28*** | (2006.01) |
| *H04R 5/033* | (2006.01) |

(52) U.S. Cl.

CPC ..... *H04R 1/2811* (2013.01); *H04R 1/1008* (2013.01); *H04R 5/033* (2013.01)

(58) Field of Classification Search

CPC ..... H04R 1/10; H04R 1/1008; H04R 1/1091; H04R 5/033; H04R 5/0335

USPC ..... 381/74, 309, 182, 370, 373, 374, 186

See application file for complete search history.

(56) References Cited

U.S. PATENT DOCUMENTS

| | | | | |
|---|---|---|---|---|
| 5,708,725 | A * | 1/1998 | Ito | H04R 5/0335 381/370 |
| 7,298,861 | B2 * | 11/2007 | Ermens | H04R 9/06 381/386 |
| 2004/0264727 | A1 * | 12/2004 | Kim | H04R 1/2819 381/370 |
| 2013/0343591 | A1 * | 12/2013 | Brunner | H04R 1/1066 381/371 |
| 2014/0126755 | A1 * | 5/2014 | Strasberg | H04R 5/033 381/309 |

* cited by examiner

*Primary Examiner* — Paul S Kim
*Assistant Examiner* — Katherine Faley
(74) *Attorney, Agent, or Firm* — Muncy, Geissler, Olds & Lowe, P.C.

(57) ABSTRACT

A wearable sound box apparatus is disclosed. In one embodiment, the disclosed sound box apparatus may include a wearable element having both ends thereof extended to form two sound box accommodating areas. The wearable element may be structurally hollow, allowing for a printed circuit board (PCB), a battery, and a reflection tube to be placed therein. A sound unit placed within each of the sound box accommodating areas may be electrically connected to the PCB through a signal line. When the sound unit operates, sound waves from the sound unit are reflected within the wearable element and corresponding inverted sound waves are transmitted out of the wearable element by the reflection tube.

10 Claims, 8 Drawing Sheets

WEARABLE SOUND BOX APPARATUS

BACKGROUND

1. Technical Field

The present disclosure relates to a wearable sound box apparatus; in particular, to a wearable sound box apparatus with reduced-sized sound boxes (sound unit accommodating areas) on both sides in order to achieve better low-frequency performance.

2. Description of Related Art

The conventional sound box apparatus typically is of larger size or occupies a larger space compared with earphones, which gradually replace the sound box apparatus for the playback of music. The conventional earphones generally rely on amplifiers inside to output sound waves. Since the earphones are placed around the contour of the ears and may be too close to eardrums, soft tissues of the ears may suffer from hearing damages after going through lengthy usage periods. The above problem may be solved if a portable sound box apparatus could be utilized.

However, integrating the conventional sound box apparatus into the portable sound box apparatus in wearable form without sacrificing the characteristics of the sound box apparatus could be challenging. For example, one wearable element has been employed to be in connection with two sound boxes. With the sound box requiring some space for the sound waves to reflect/bounce, such space and the surface from which the reflected/bounced sound waves are outputted are often in the proximity (for instance, the space for the sound waves to reflect is placed behind the surface from which the bounced sound wave are outputted). Even so, when the space for the sound waves to bounce is too small corresponding sounding performance may not be satisfactory. On the other hand, if the space for the sound waves to bounce is too large carrying such sound box apparatus may become burdensome.

One potential solution to the above problem as disclosed in the present disclosure may take advantage of the space within the wearable element connecting the two sound boxes.

SUMMARY

In order to overcome the aforementioned deficiencies, the present disclosure provides a wearable sound box apparatus with a hollow connecting portion for increasing the space inside the apparatus in addition to being equipped with a reflection tube. Accordingly, the size of sound box accommodating areas at both sides of the apparatus may be reduced to achieve the better low-frequency performance and render less burdensome the use of the apparatus.

In one embodiment, the disclosed sound box apparatus may include a wearable element having both ends thereof extended to form two sound box accommodating areas. The wearable element may be structurally hollow, allowing for a printed circuit board (PCB), a battery, and a reflection tube to be placed therein. A sound unit placed within each of the sound box accommodating areas may be electrically connected to the PCB through a signal line. When the sound unit operates, sound waves from the sound unit are reflected within the wearable element and corresponding inverted sound waves are transmitted out of the wearable element by the reflection tube.

Specifically, the sound box accommodating areas are hollow in structure and communicative with the wearable element.

Specifically, the sound unit may further include a surface from which the sound waves penetrate. The surface may include a cone, a dust cap, and a surround, a frame, a damper, a voice coil, and a magnet set are integrated with the surface. The diameter of a bottom of the frame is larger than the diameter of a top of the frame.

Specifically, the diameter of the damper is smaller than the diameter of the bottom of the frame but larger than the diameter of the top of the frame.

Specifically, the diameter of the magnet set is smaller than the diameter of the bottom of the frame but larger than the diameter of the top of the frame.

Specifically, the surfaces of the sound units from which the sound waves penetrate in the sound box accommodating areas face in different directions.

Specifically, the surfaces of the sound units from which the sound waves penetrate in the sound box accommodating areas face in the same direction.

Specifically, the reflection tube may further include a reflection hole on a surface of the wearable element and a guiding pipe formed by the reflection hole extending inwardly with respect to the wearable element.

Specifically, the PCB may further include a battery.

Specifically, the wearable element hollow in structure increases the volume of the sound box accommodating areas.

In another embodiment, a wearable sound box apparatus may include a wearable element having both ends thereof extended to form two sound box accommodating areas. The wearable element may be structurally hollow, a printed circuit board (PCB) may be placed within each or both of the sound box accommodating areas, a reflection tube may be placed within the wearable element, and a sound unit may be placed within each of the sound box accommodating areas and electrically connected to the PCB through a signal line. When the sound unit operates, sound waves from the sound unit are reflected within the wearable element and corresponding inverted sound waves are transmitted out of the wearable element by the reflection tube.

Specifically, the sound box accommodating areas are hollow in structure and communicative with the wearable element.

Specifically, the sound unit may further include a surface from which the sound waves penetrate, the surface may include a cone, a dust cap, and a surround, a frame, a damper, a voice coil, and a magnet set are integrated with the surface. The diameter of a bottom of the frame is larger than the diameter of a top of the frame.

Specifically, the diameter of the damper is smaller than the diameter of the bottom of the frame but larger than the diameter of the top of the frame.

Specifically, the diameter of the magnet set is smaller than the diameter of the bottom of the frame but larger than the diameter of the top of the frame.

Specifically, the surfaces of the sound units from which the sound waves penetrate in the sound box accommodating areas face in different directions.

Specifically, the surfaces of the sound units from which the sound waves penetrate in the sound box accommodating areas face in the same direction.

Specifically, the reflection tube may further include a reflection hole on a surface of the wearable element and a guiding pipe formed by the reflection hole extending inwardly with respect to the wearable element.

Specifically, the PCB may further include a battery.

Specifically, the wearable element hollow in structure increases the volume of the sound box accommodating areas.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of a preferred embodiment corresponding with the reference Figures.

Figure 2:
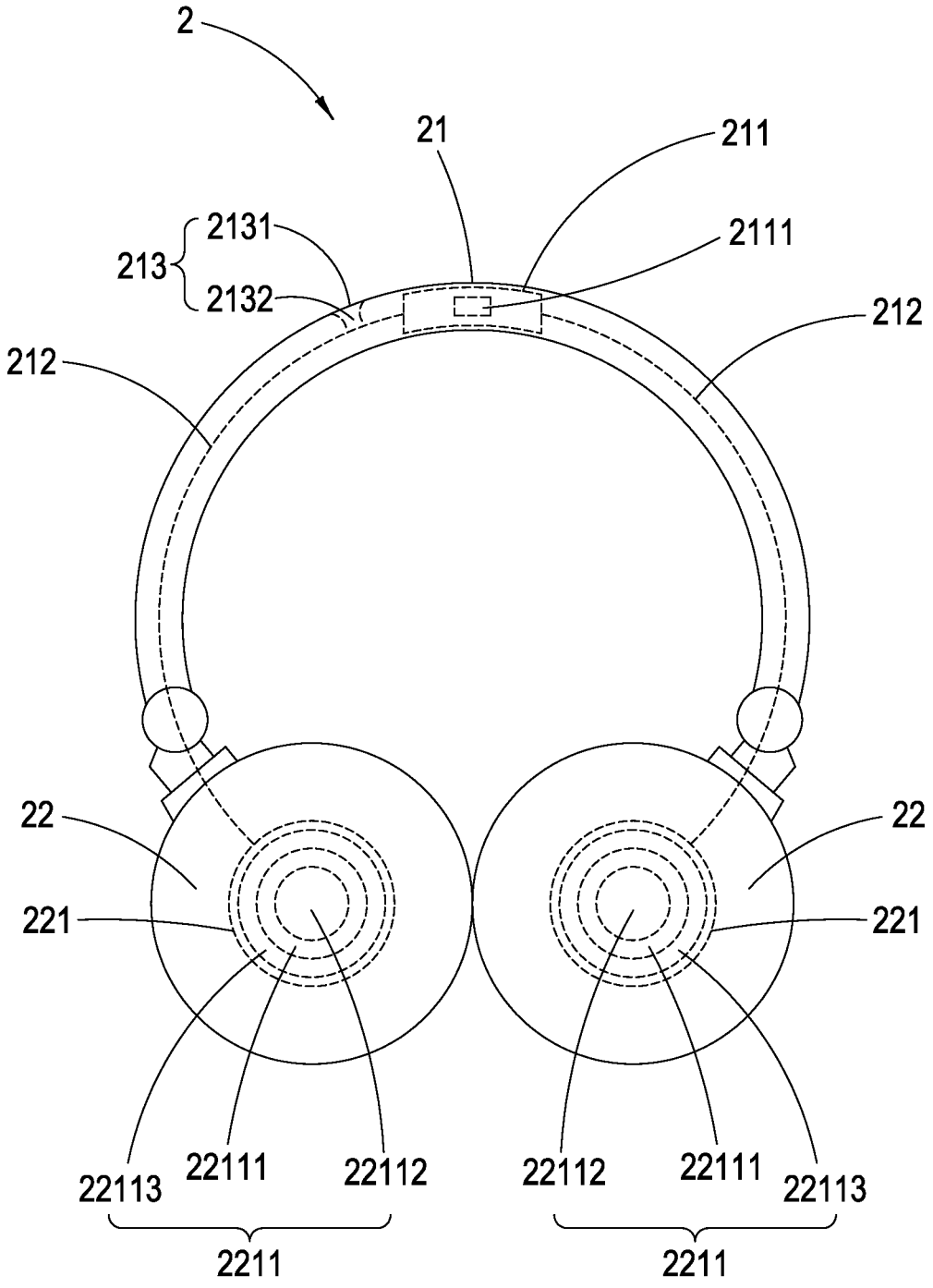
FIG. 2 shows a partial structural schematic diagram of a wearable sound box apparatus according to an embodiment of the present disclosure.
Figure 3A:
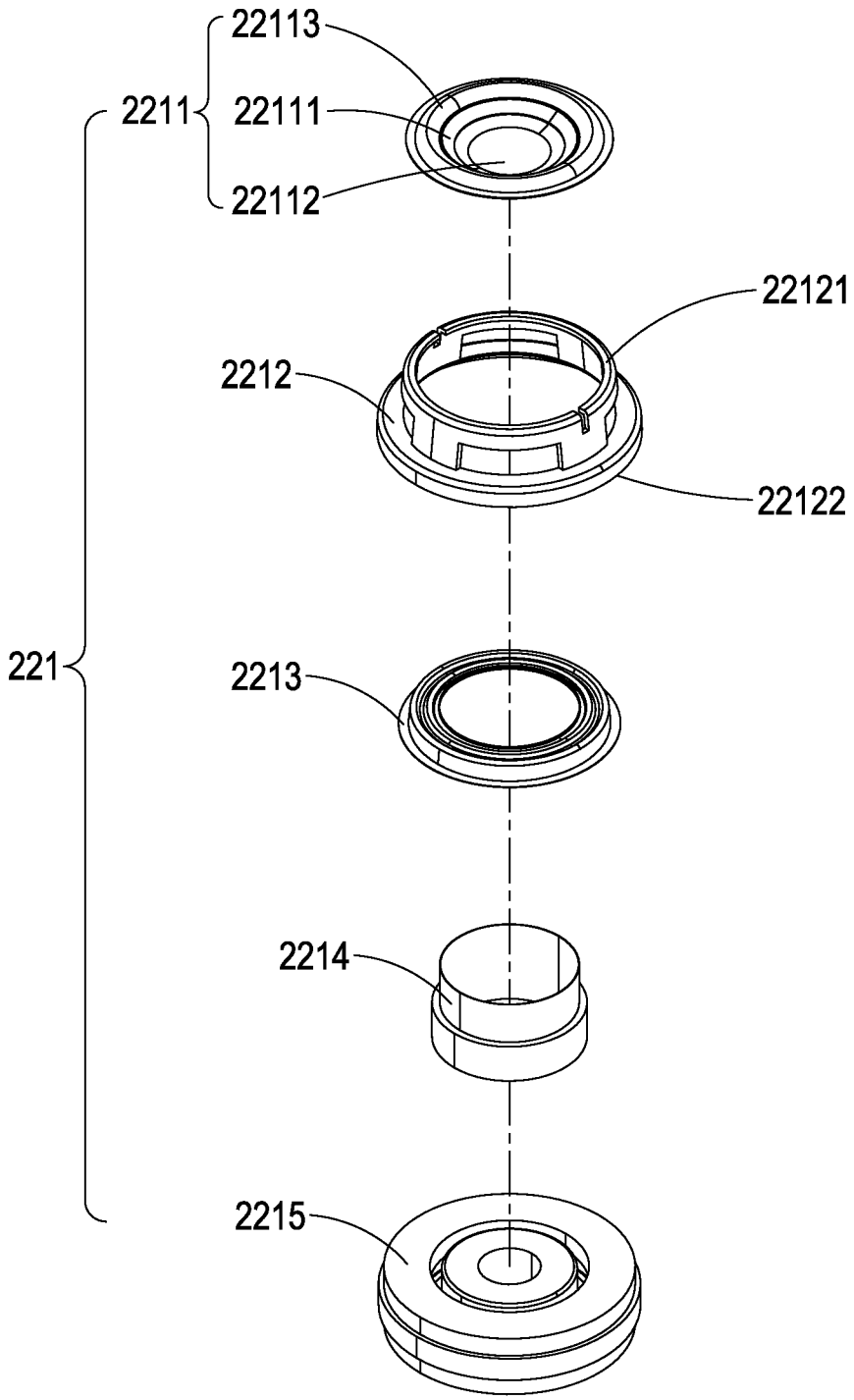
FIG. 3A shows a structural exploded diagram of a sound unit of the wearable sound box apparatus according to an embodiment of the present disclosure.
Figure 3B:
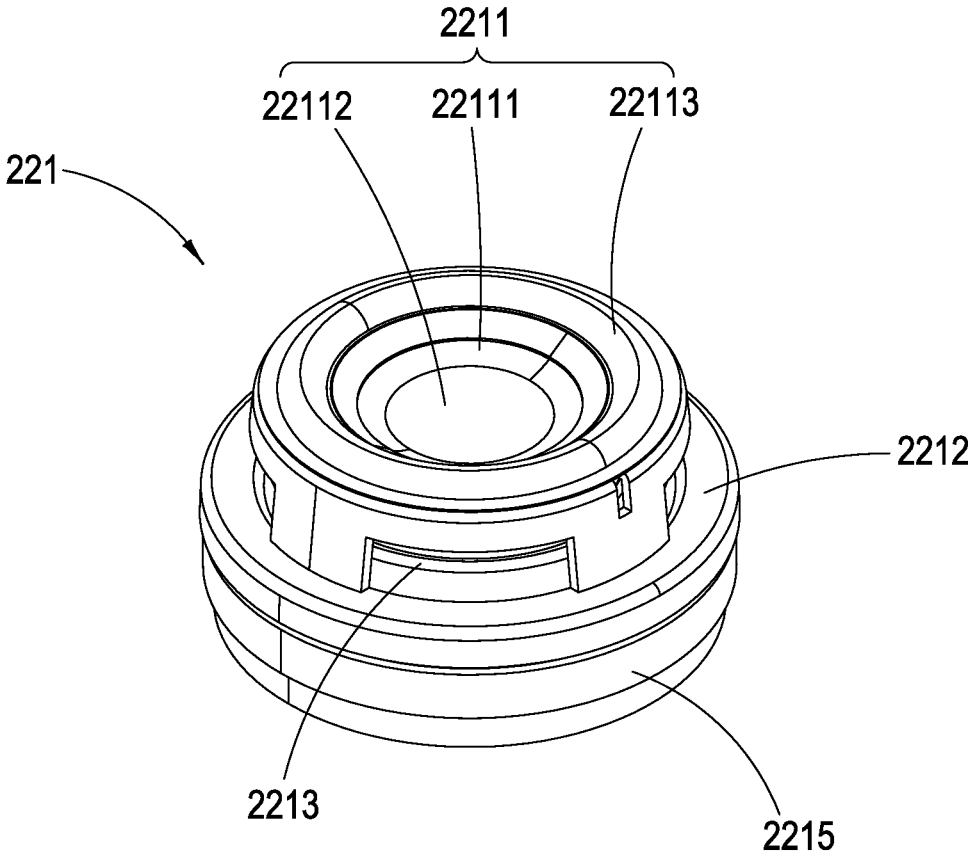
FIG. 3B shows an structural integrated diagram of a sound unit of the wearable sound box apparatus according to an embodiment of the present disclosure.

Please refer to FIGS. 2 and 3A-B of a partial schematic diagram of a wearable sound box apparatus, an exploded view of a sound unit, and an integrated schematic diagram of the sound unit according to one embodiment of the present disclosure, respectively. As shown from the above figures, a wearable sound box apparatus 2 may include a wearable element 21 having two sound box accommodating areas 22 extended from both ends thereof. Each of the sound box accommodating areas 22, which may be structurally hollow, may include a sound unit 221. The wearable element 21 may be structurally hollow as well, allowing for a printed circuit board (PCB) 211, a battery 2111, and a reflection tube 213 to be disposed therein. The sound unit 221 within the sound box accommodating area 22 may be electrically connected to the PCB 211 through a signal line 212.

The reflection tube 213 may define a reflection hole 2131 on a surface of the wearable element 21 and a guide pipe 2132. The guide pipe 2132 may be formed by the reflection hole 2131 extending inwardly with respect to the wearable element 21. When the sound unit 221 operates, sound waves from the sound unit 221 may travel and bounce within the wearable element 21. Reflected/bounced sound waves may become inverted counterparts, which may be outputted by the reflection tube 213. The space for the sound waves to bounce may be the space within the hollow wearable element 21, eliminating the need of the large-sized sound box accommodating areas 22. Specifically, the sound box accommodating area may only need to be large enough for the sound unit to be disposed. By further adjusting the space within the wearable element 21, the space for the sound waves to bounce may be sufficient for the better low-frequency performance to be achieved.

Figure 1:
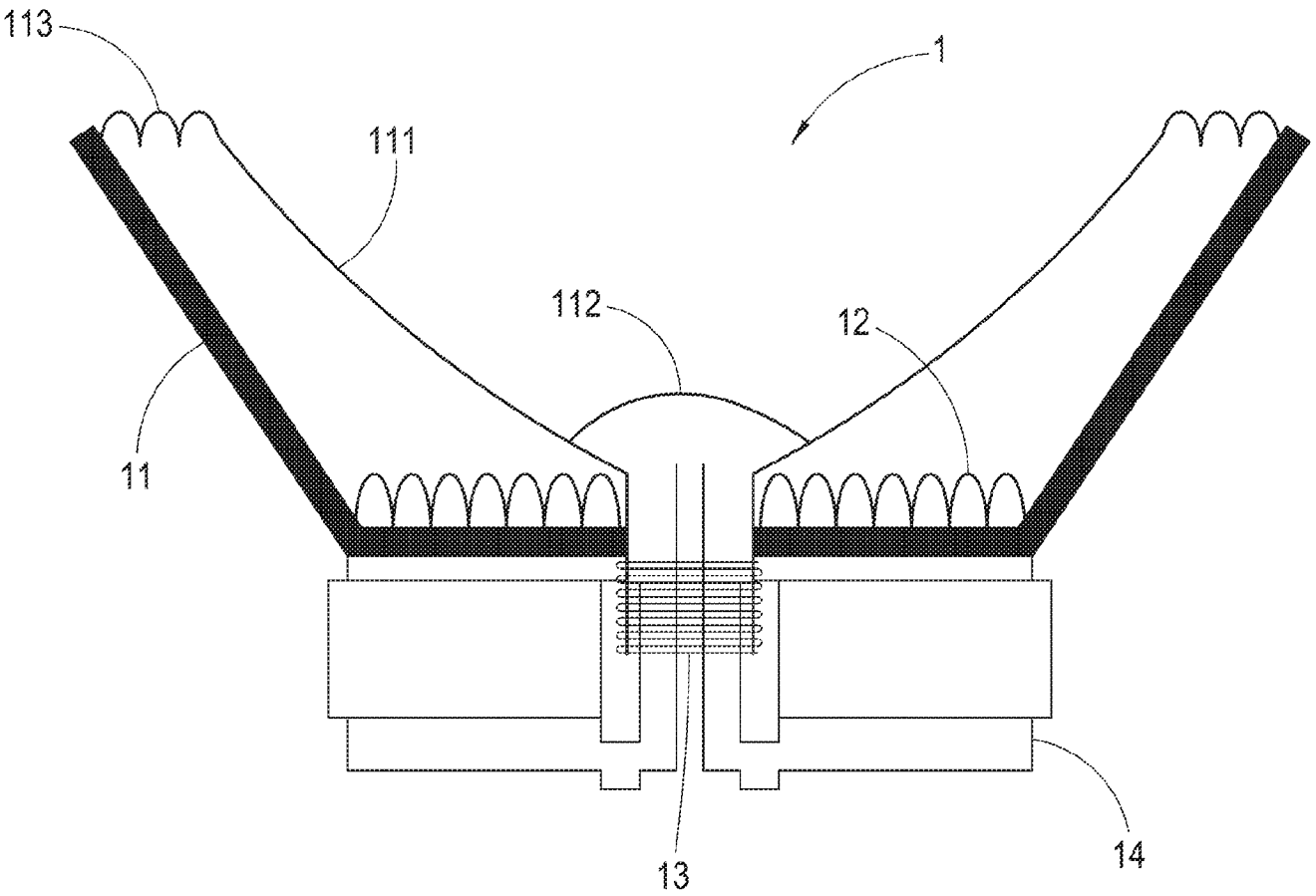
FIG. 1 PRIOR ART
FIG. 1 shows a structural schematic diagram of a conventional sound unit.
Figure 4:
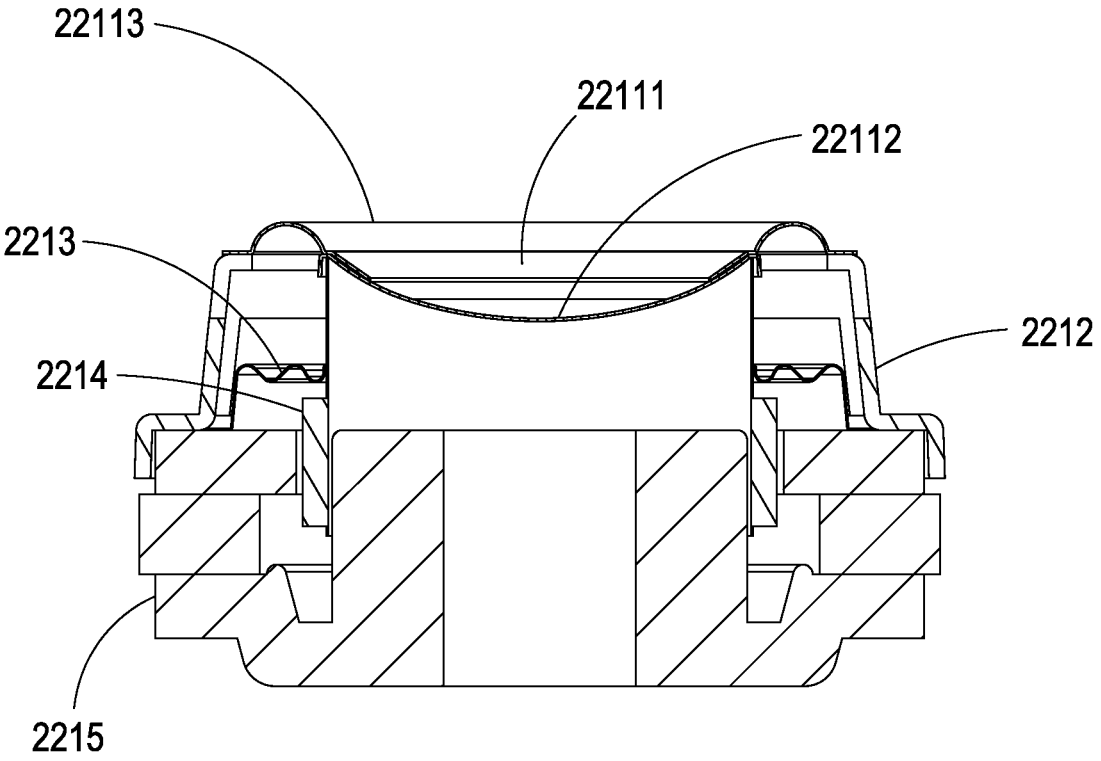
FIG. 4 is a cross-sectional view of a sound unit of the wearable sound box apparatus according to an embodiment of the present disclosure.

The sound unit 221 of the present disclosure may be different from the conventional sound unit 1 shown in FIG. 1. As shown in FIGS. 3A-B and 4, the sound unit 221 may include a surface 2211 from which the sound waves may be outputted and such surface 2211 may include cone 2211, a dust cap 22112, and a surround 22113. The sound unit 221 may further include a frame 2212, a damper 2213, a voice coil 2214, a magnet set 2215, despite the conventional sound unit 1 may include a frame 11 integrated with a cone 111, a dust cap 112, and a surround 113, a damper 12, a voice coil 13, and a magnet set 14.

The frame 11 of the sound unit 1 is wider at its top (compared to its bottom), which is not the case in the present disclosure. The frame 2212 may be with a frame top 22121 and a frame bottom 22122. The diameter of the frame bottom 22122 may be larger than the diameter of the frame top 22121 with the diameters of the damper 2213 and the magnet set 2215 smaller than the diameter of the frame bottom 22122 but larger than the diameter of the frame top 22121.

Since the frame 2212 is wider at its bottom (compared to its top), which is oppositely different from the structure of the frame 11 of the sound unit 1, the surface of the damper 2213 and the size of the magnet set 2215 with a magnet and a pole piece may enlarge. The increase in size of the damper 2213 and the magnet set 2215 may therefore cause the magnetic circuitry to be larger than the vibration area of the cone 22111, the dust cap 22112, and the surround 22113, reducing both Q value and the resonant frequency of the sound unit 221 and increasing the compliance and the sound pressure level (SPL) of the sound unit 221.

Figure 5:
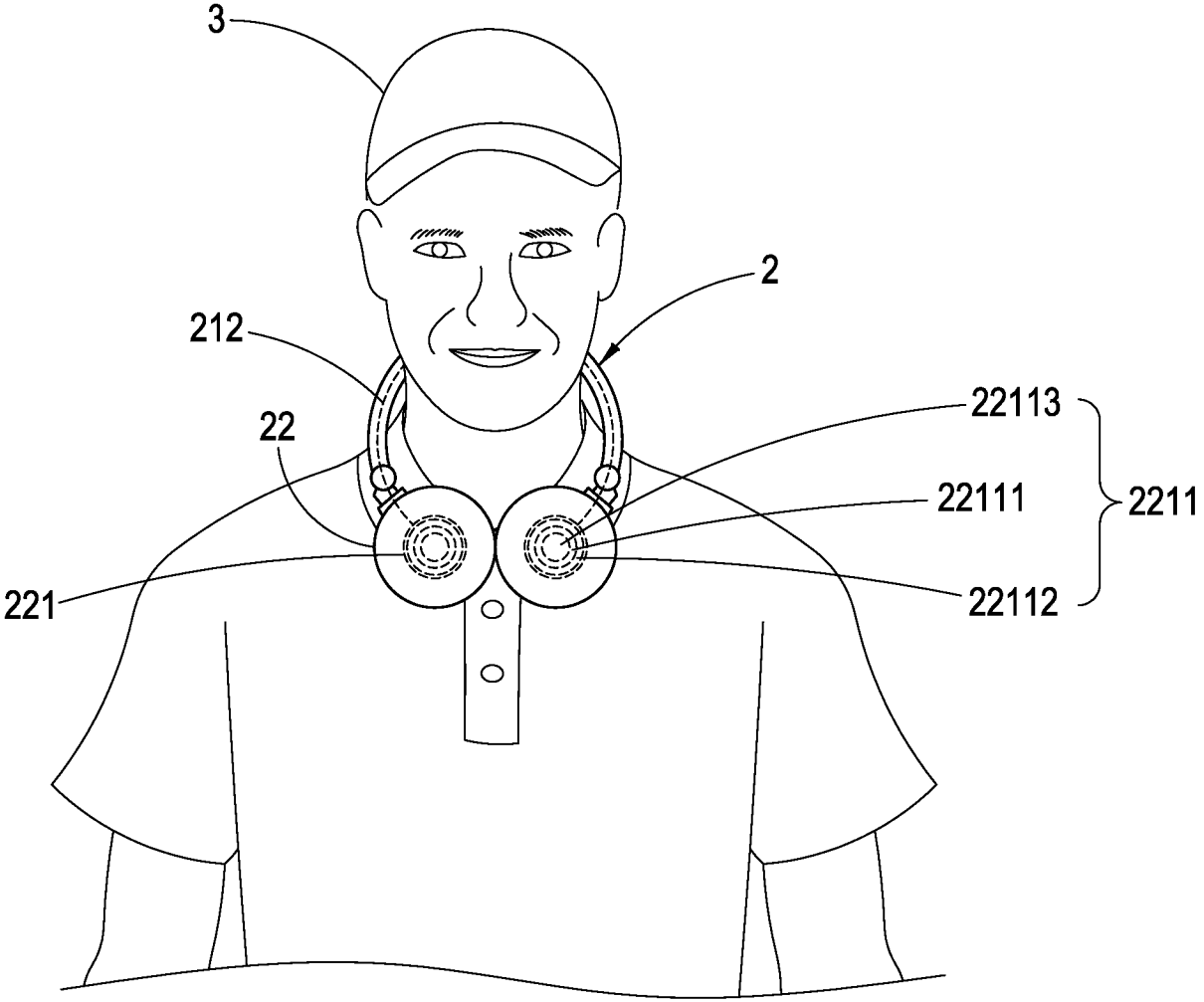
FIG. 5 is a schematic diagram showing the wearable sound box apparatus being worn according to an embodiment of the present disclosure.

As shown in FIG. 5, because of the wearable element 21 the wearable sound box apparatus may be placed anywhere of a human operator if allowed. For example, the wearable sound box apparatus 2 may hang around the neck of the human operator 3. The surface from which the sound waves may output could face in any direction to meet the needs. Specifically, both surfaces 2211 from which the sound waves may be outputted of the two sound units 221 illustrated in FIGS. 2 and 5 may face front at the same time, while the two surfaces 2211 from which the sound waves may be outputted may face right and left, respectively, in the embodiment in FIG. 6. In short, there is no limitation/restriction to the direction in which the surfaces 2211 from which the sound waves output of the sound units 221 face.

Figure 6:
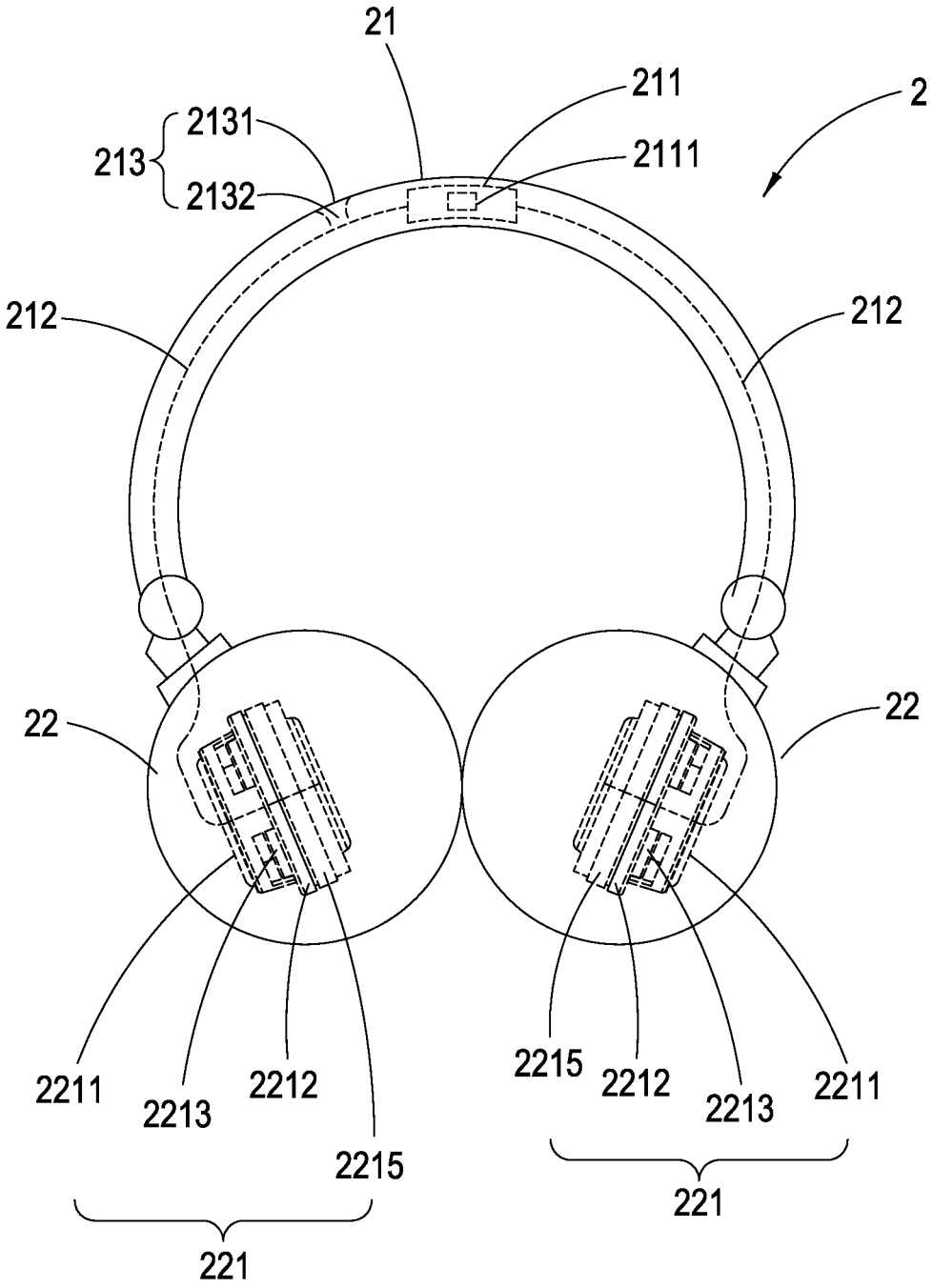
FIG. 6 shows an arrangement of a surface from which sound waves output of the wearable sound box apparatus according to an embodiment of the present disclosure.
Figure 7:
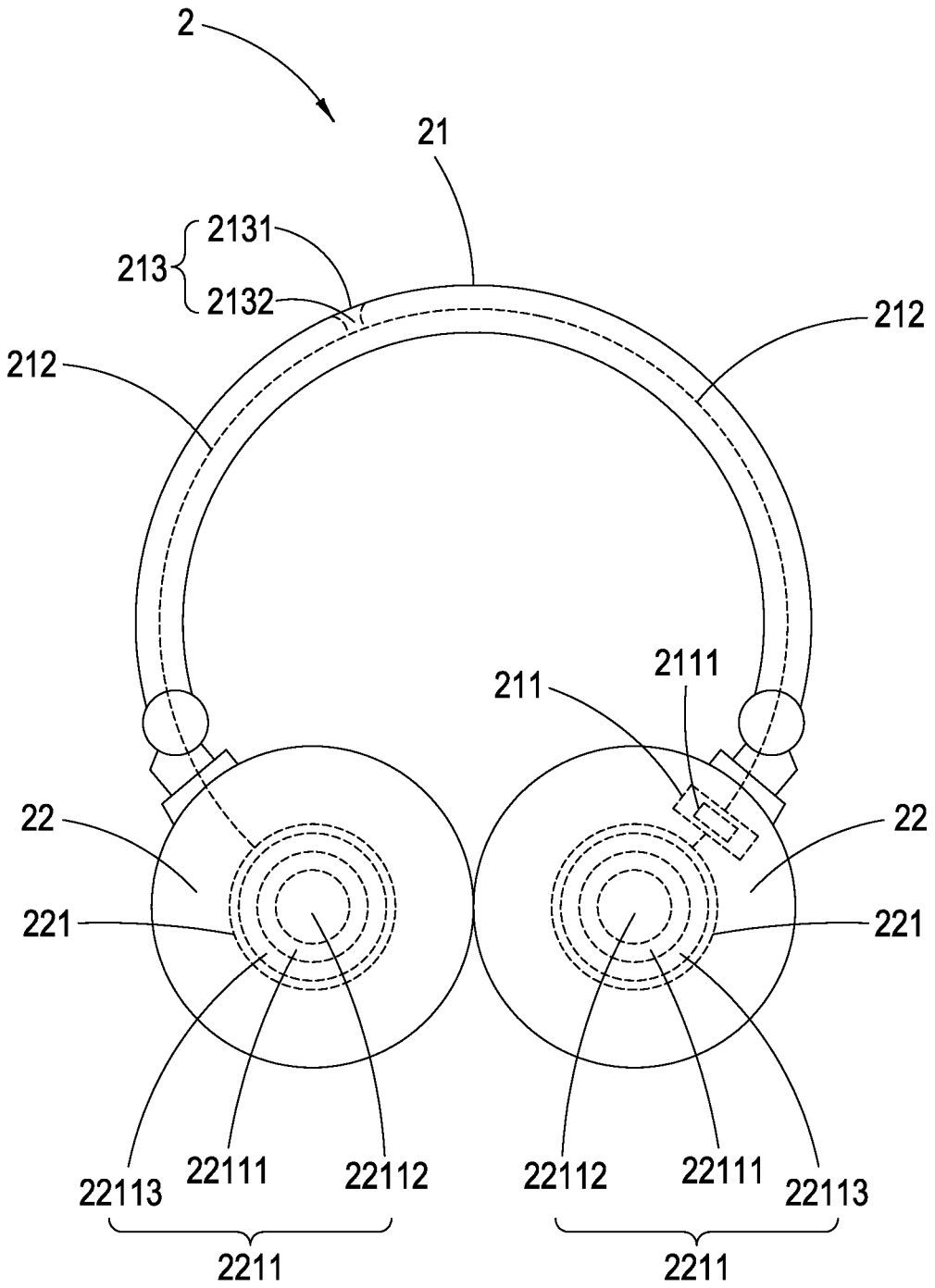
FIG. 7 is a schematic diagram showing the placement of a PCB of the wearable sound box apparatus according to an embodiment of the present disclosure.

In one implementation, as shown in FIG. 6, the wearable element 21 may not be materially flexible and the PCB 211 may still be placed within the wearable element 21. In another implementation, the wearable element 21 may be flexible in nature and to avoid such wearable element 21 from being overly bent to accidentally damage the PCB 211 the PCB 211 may be alternatively placed within the sound box accommodating area 22.

Compared with the conventional arts, the present disclosure, may be with following advantages: (1) with the wearable element being structurally hollow the space for the sound waves to bounce before being outputted may increase to achieve the better low-frequency performance and the volume of the sound box accommodating areas may be reduced to render less burdensome the use of the disclosed sound box apparatus, and (2) with the frame of the sound unit being wider at its bottom the surface of the damper and the size of the magnet set may increase to enlarge the magnetic circuitry to be larger than the vibration area, reducing the Q value of the sound unit and the resonant frequency while increasing the compliance and the sound pressure level.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A wearable sound box, comprising:

a wearable element having both ends thereof extended to form two sound box accommodating areas, the wearable element being structurally hollow; a printed circuit board (PCB) and a reflection tube, both placed within the wearable element; and a sound unit placed within each of the sound box accommodating areas and electrically connected to the PCB through a signal line; and wherein when the sound unit operates, sound waves from the sound unit are reflected within the wearable element and corresponding inverted sound waves are transmitted out of the wearable element by the reflection tube, and the sound unit further comprises a surface from which the sound waves penetrate; wherein the surface comprises a cone, a dust cap, and a surround, a frame, a damper, a voice coil, and a magnet set are integrated with the surface; and wherein the diameter of a bottom of the frame is larger than the diameter of a top of the frame and the diameter of the damper is smaller than the diameter of the bottom of the frame but larger than the diameter of the top of the frame.

2. The wearable sound box according to claim 1, wherein the sound box accommodating areas are hollow in structure for increasing the volume of the sound box accommodating areas and communicative with the wearable element and the PCB is with a battery placed thereon.

3. The wearable sound box according to claim 1, wherein the diameter of the magnet set is smaller than the diameter of the bottom of the frame but larger than the diameter of the top of the frame.

4. The wearable sound box according to claim 1, wherein the surfaces of the sound units from which the sound waves penetrate in the sound box accommodating areas face in either the same direction or different directions.

5. The wearable sound box according to claim 1, wherein the reflection tube further comprises a reflection hole on a surface of the wearable element and a guiding pipe formed by the reflection hole extending inwardly with respect to the wearable element.

6. A wearable sound box apparatus, comprising: a wearable element having both ends thereof extended to form two sound box accommodating areas, the wearable element being structurally hollow; a printed circuit board (PCB) placed within each of the sound box accommodating areas, a reflection tube placed within the wearable element, and a sound unit placed within each of the sound box accommodating areas and electrically connected to the PCB through a signal line; and wherein when the sound unit operates sound waves from the sound unit are reflected within the wearable element and corresponding inverted sound waves are transmitted out of the wearable element by the reflection tube, and the sound unit further comprises a surface from which the sound waves penetrate; wherein the surface comprises a cone, a dust cap, and a surround, a frame, a damper, a voice coil, and a magnet set are integrated with the surface and wherein the diameter of a bottom of the frame is larger than the diameter of a top of the frame and the diameter of the damper is smaller than the diameter of the bottom of the frame but larger than the diameter of the top of the frame.

7. The wearable sound box apparatus according to claim 6, wherein the sound box accommodating areas are hollow in structure for increasing the volume of the sound box accommodating areas and communicative with the wearable element and the PCB is with a battery placed thereon.

8. The wearable sound box apparatus according to claim 6, wherein the diameter of the magnet set is smaller than the diameter of the bottom of the frame but larger than the diameter of the top of the frame.

9. The wearable sound box apparatus according to claim 6, wherein the surfaces of the sound units from which the sound waves penetrate in the sound box accommodating areas face in either the same direction or different directions.

10. The wearable sound box apparatus according to claim 6, wherein the reflection tube further comprises a reflection hole on a surface of the wearable element and a guiding pipe formed by the reflection hole extending inwardly with respect to the wearable element.

* * * * *